US006957578B2

(12) United States Patent
Birlem

(10) Patent No.: US 6,957,578 B2
(45) Date of Patent: Oct. 25, 2005

(54) YARN SENSOR

(75) Inventor: Olav Birlem, Schwalmtal (DE)

(73) Assignee: W. Schlafhorst AG & Co., Moenchengladbach (DE)

( * ) Notice: Subject to any disclaimer, the term of this patent is extended or adjusted under 35 U.S.C. 154(b) by 0 days.

(21) Appl. No.: 10/269,163

(22) Filed: Oct. 11, 2002

(65) Prior Publication Data

US 2003/0070481 A1 Apr. 17, 2003

(30) Foreign Application Priority Data

Oct. 12, 2001 (DE) ..... 101 50 581

(51) Int. Cl.[7] ..... G01L 5/04

(52) U.S. Cl. ..... 73/160

(58) Field of Search ..... 73/159, 160, 862.361

(56) References Cited

U.S. PATENT DOCUMENTS

| | | | | |
|---|---|---|---|---|
| 3,377,852 A | | 4/1968 | Leistra | 73/160 |
| 4,004,194 A | | 1/1977 | Doerflinger et al. | 317/100 |
| 4,300,341 A | | 11/1981 | Pozzo | 57/80 |
| 4,670,655 A | * | 6/1987 | Zierhut | 250/342 |
| 4,970,402 A | * | 11/1990 | de Vuyst et al. | 250/559.12 |
| 5,013,911 A | * | 5/1991 | Koshida et al. | 250/239 |
| 5,468,909 A | | 11/1995 | Schonberger et al. | 174/101 |
| 6,018,125 A | * | 1/2000 | Collins et al. | 174/35 R |
| 6,222,732 B1 | | 4/2001 | Jakob et al. | 361/704 |
| 6,541,284 B2 | * | 4/2003 | Lam | 438/7 |

FOREIGN PATENT DOCUMENTS

| | | |
|---|---|---|
| DE | 2 255 430 | 5/1973 |
| DE | 38 20 173 A1 | 12/1989 |
| DE | 38 30 665 A1 | 3/1990 |
| DE | 39 29 895 A1 | 3/1991 |
| DE | 42 31 314 C2 | 9/1997 |
| EP | 0 401 600 A2 | 5/1990 |
| EP | 0 799 912 A1 | 8/1997 |
| EP | 0 945 533 A1 | 9/1999 |

OTHER PUBLICATIONS

European Search Report.
"Elektrish leitende Kunststoffe" [Electrically Conducting Plastic Materials] 1986 by H. J. Mair and S. Roth.
German Search Report.

* cited by examiner

*Primary Examiner*—Max Noori
(74) *Attorney, Agent, or Firm*—Kennedy Covington Lobdell & Hickman, LLP

(57) ABSTRACT

A yarn sensor (25) for monitoring at least one parameter of a traveling yarn (17), e.g., in spinning and bobbin-winding machines, has a measuring gap (16) and a housing made of a non-conductive plastic material for containing electronic components. The housing surface is covered by a metallic coating such that the electronic components are surrounded by the coating (21). At least a portion of the surface inside the measuring gap (16) is free of the coating (21). The metallic coating is connected with a heat conductor to remove heat via the metallic coating (21). Undesirable effects on the measurement results can be substantially reduced, and the quality of the measurement results can be increased.

5 Claims, 3 Drawing Sheets

YARN SENSOR

CROSS-REFERENCE TO RELATED APPLICATIONS

This application claims the benefit of German patent application 10150581.7 filed Oct. 12, 2001, herein incorporated by reference.

BACKGROUND OF THE INVENTION

The present invention relates generally to textile yarn sensors and, more particularly, to a yarn sensor having an electronic component housing made of plastic with a measuring gap for monitoring at least one parameter of a running yarn.

Yarn sensors of diverse types are employed at work stations of textile machines, for example of spinning or bobbin-winding machines. Metallic housings, in which the electronic components have been installed, can be used for yarn sensors. Such metallic housings are customarily mass-produced by diecasting, since the diecasting process is considerably more cost-effective compared with a cutting operation, for example. Metals that are suitable for diecasting are aluminum, zinc or magnesium. Although aluminum is advantageous as being lightweight, it has the disadvantage that no fine contours can be formed from this material by means of a diecasting process. Although zinc permits the formation of fine contours because of its low viscosity, it is twice as heavy as aluminum and is very brittle. Fine contours can be formed with magnesium, and this material is approximately as light as aluminum, but it is not resistant to reaction with air and therefore is subject to oxidation.

If plastic is selected as the housing material, the above mentioned disadvantages can be avoided. The advantages of low material costs, low production costs, low weight, as well as resistance to chemicals can be used. The formation of fine contours is possible without problems. However, a plastic material acting as an insulator does encourage electrostatic charging, which can be generated if an electrostatic charge created by friction is passed to the yarn sensor by the traveling yarn. In case of capacitive measurements, undesirable measuring errors can occur in this way.

Such electrostatic charging is to be prevented by means of a yarn measuring device in accordance with U.S. Pat. No. 3,377,852, for example, whose block-shaped body is made of an insulating material. Electrodes are arranged on the block on both sides of the measuring gap such that they constitute a capacitor, which is suitable for yarn measuring purposes. The surface in the measuring gap, including the surface of the electrodes arranged therein, is coated with a thin layer of material which acts as a weakly insulating material. With the aid of this layer, it is intended to distribute electrical charges in the measuring gap and to slowly dissipate them. The insulating effect, or the electrical conductivity of the layer, is intended to be such that in no case does it act as an extension of the electrode surface, since this could lead to the distortion of the measurement results. It is specifically pointed out in the publication that the required function of the measuring device is no longer provided if the electrical resistance of the layer is set too low.

German Patent Publication DE 39 29 895 A1 describes a yarn break detector with a metallized plastic housing. The front of the housing is not metallized, so that the shielding remains incomplete and interfering effects can act from the outside. This yarn break detector makes it possible to detect whether or not there is yarn within the detection range. This yarn break detector cannot meet increased requirements made on the quality of measurements.

European Patent Publication EP 0 401 600 A2, discloses a measuring head having a housing extruded from plastic for measuring, or monitoring, parameters of a running yarn. An optical and a capacitive measuring element are combined inside the measuring head and are both arranged in the housing together. A support plate with the components for optical and capacitive measuring has been inserted into the housing and screwed together with it. Toward the measuring gap, the light source and the light receptor are each covered by a disk. The capacitor plates for capacitive measurement are applied to or embedded in the disks in the form of an electrically conducting transparent layer of metal.

However, these known yarn sensors are not capable of removing or avoiding a number of undesirable effects. For example, in measuring elements or processors, such as are arranged in the interior of yarn sensors, or of the housings, waste heat is often generated, which results in a considerable increase of the interior housing temperature. Increased temperatures can result in undesired and disadvantageous so-called component drifting in the electrical components installed in the housing. Magnetic, or electrical fields, in particular fields with oscillating field strengths, which originate in the vicinity of the yarn sensor, can distort the measured result in an undesired manner.

SUMMARY OF THE INVENTION

It is accordingly an object of the present invention to improve the properties of known yarn sensors having a housing made of a non-conductive plastic material.

In accordance with the present invention, this objective is addressed by providing a yarn sensor for monitoring at least one parameter of a traveling yarn, wherein the yarn sensor comprises a housing of non-conductive plastic material enclosing electronic components, with an outer surface of the housing having a metallic covering, preferably a metallic coating, for substantially enclosing the electronic components, and with the housing defining a measuring gap having an inside surface at least a portion of which is free of the metallic covering.

In a housing coated in accordance with the invention, the electronic components of the measuring elements, the processors and also the measuring area in the measuring gap are satisfactorily shielded against the effects of electrical, or magnetic fields. In this case, the coating of the housing effectively forms a Faraday cage. Distortions of the measured results by foreign fields are prevented. Since at least a portion of the surface in the measuring gap is free of coating, the rays or lines of flux used for measuring can spread without hindrance from the transmitting measuring element to the receiving measuring element. In this manner, any interference with or distortion of the beam path, or of the path of the lines of flux, by the coating, which would result in erroneous measuring results, is prevented.

The yarn sensor is connected with a heat conductor in such a way that heat can be easily dissipated via the metallic coating. For example, this heat dissipation can take place by means of the largest possible contact face between the yarn sensor coated in accordance with the invention and a holding plate fastened on the metallic machine frame. Thus, it is possible to achieve a high heat dissipation capability, by means of which a temperature increase can be countered. The maintenance of a high measuring accuracy can be assured in this way.

Preferably, at least a part of the coating is applied with the aid of a galvanic coating process. Galvanic coating processes provide particularly even, complete and gap-less coatings, which can be produced on a chemically applied base layer in a cost-effective manner.

Extensive explanations regarding chemical-galvanic coating methods can be taken from German Patent Publication DE-OS 22 55 430, for example. In this case, the non-conductive surface of a body to be coated is subjected to preparatory treatment. The preparatory treatment can consist of mechanical micro-roughening by sand-blasting and dipping into a chemical treatment bath which is capable of making surfaces, which are hydrophobic per se, become hygroscopic. A subsequent chemically produced metallic precipitation can constitute the basis for the electrolytic buildup of one or several applied metallic layers. The thickness of the base layer should not exceed 5 micrometers ($\mu$m).

In accordance with another aspect of the invention, the coating or other covering preferably has a copper base layer with a covering layer of nickel or chromium thereover. In this way, the excellent heat conductivity and the high electrical conductivity of copper is combined with advantageously usable properties of nickel or chromium, such as wear protection or magnetic shielding.

Advantageously, the thickness of the coating lies between 5 $\mu$m and 20 $\mu$m. On the one hand, a well adhering coating with a relatively limited length of the coating process can be produced in this manner and, on the other hand, the desired effects, or function, of the coating can be achieved to a sufficient degree.

The resistance of the surface of the plastic housing against mechanical effects, such as abrasion, or scratches, can be increased by means of the coating of the surface.

The housing can comprise several parts, which are combined into a unit.

Undesirable effects of the measured result can be substantially reduced or completely prevented by means of a yarn sensor embodied in accordance with the invention. These effects can be generated if components inside the housing of the yarn sensor are subjected to increased temperatures or magnetic or electrical fields. A so-called component drifting is thereby counteracted. Component drifting may occur if, for example, the temperature to which the measuring element is subjected increases and an error in measured values or in processing of signals thereby occurs or is increased. The waste heat generated in the housing by electrical components arranged therein can be removed to a sufficient degree by means of the sensor in accordance with the invention. Electrostatic charging is also removed by means of the coating in accordance with the invention.

The quality of the measured results, the quality of yarn monitoring, and therefore the quality of the yarn itself is increased. Besides improved wear protection of the housing, the coating in accordance with the present invention opens up design possibilities for a pleasing visual appearance of the yarn sensor, for example by means of a chromed surface.

Further details, features and advantages of the present invention will be explained with reference to a representative embodiment shown in the accompanying drawing figures.

DESCRIPTION OF THE PREFERRED EMBODIMENT

The employment and the arrangement of yarn sensors at textile machines, such as spinning or bobbin-winding machines, is known per se, for example from the above mentioned publications, and therefore need not be explained in detail herein.

Figure 1:
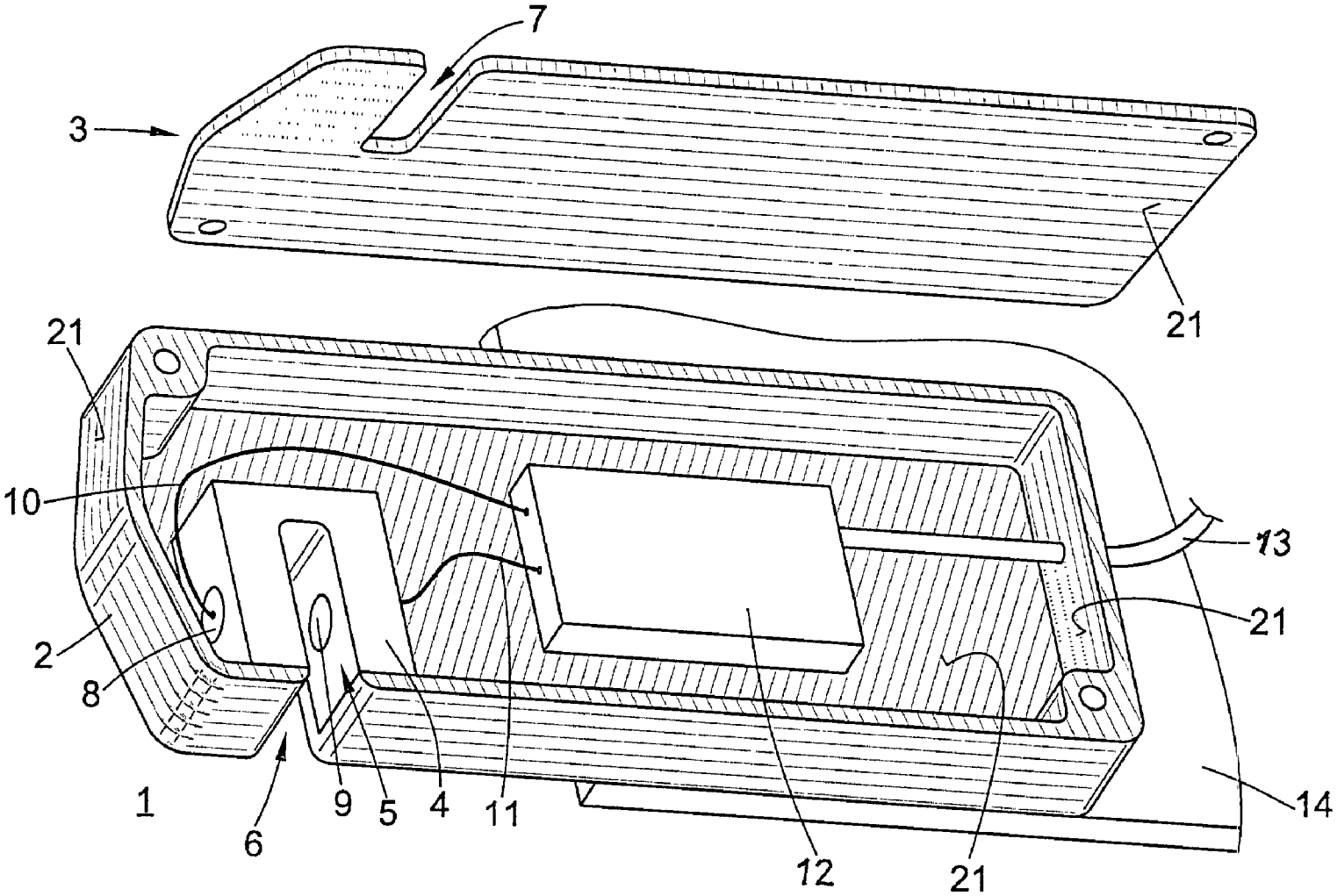
FIG. 1 is a simplified exploded perspective view of a yarn sensor in accordance with the present invention, showing the housing with an opened cover.

The yarn sensor 1 represented in FIG. 1 has a housing comprised of a box-shaped base body 2 with a removable cover 3. A measuring device 4 with a measuring gap 5, through which the yarn travels in the longitudinal direction during the measurement, is arranged in the base body 2. In the exemplary embodiment in FIG. 1, the surface of the measuring gap 5 is not metallic-coated. The base body 2, as well as the cover 3, each have recesses 6, 7, whose disposition is matched to the measuring gap 5.

The measuring device 4 is operated with a light source 8 and an optical sensor 9, each of which is connected via the line 10 and the line 11 with the processor 12. The processor 12 is fastened on the bottom of the base body 2 and embodied as a so-called ASIC. After putting the base body 2 and the cover 3 together, the processor 12 is located in the hollow space formed in this manner in the interior of the closed yarn sensor. In an alternative embodiment, it is possible to arrange more than one processor for signal and data processing in the housing.

The processor 12 is connected via the line 13 with the central control of the textile machine, not represented for sake of simplicity. In this case, the line 13 is also additionally used for supplying electrical energy, besides the transmission of data and other signals. The surface of the base body 2 and the cover 3 are metallic-coated. The coating covers the outer, as well as the inner surface of the housing facing the hollow space. In FIG. 1, as well as in FIG. 2, the coated surfaces are represented as hatched surfaces.

The base body is fastened on the support plate 14, wherein the coated surface rests directly on the surface of the support plate 14. The support plate 14 acts as a heat conductor.

Figure 2:
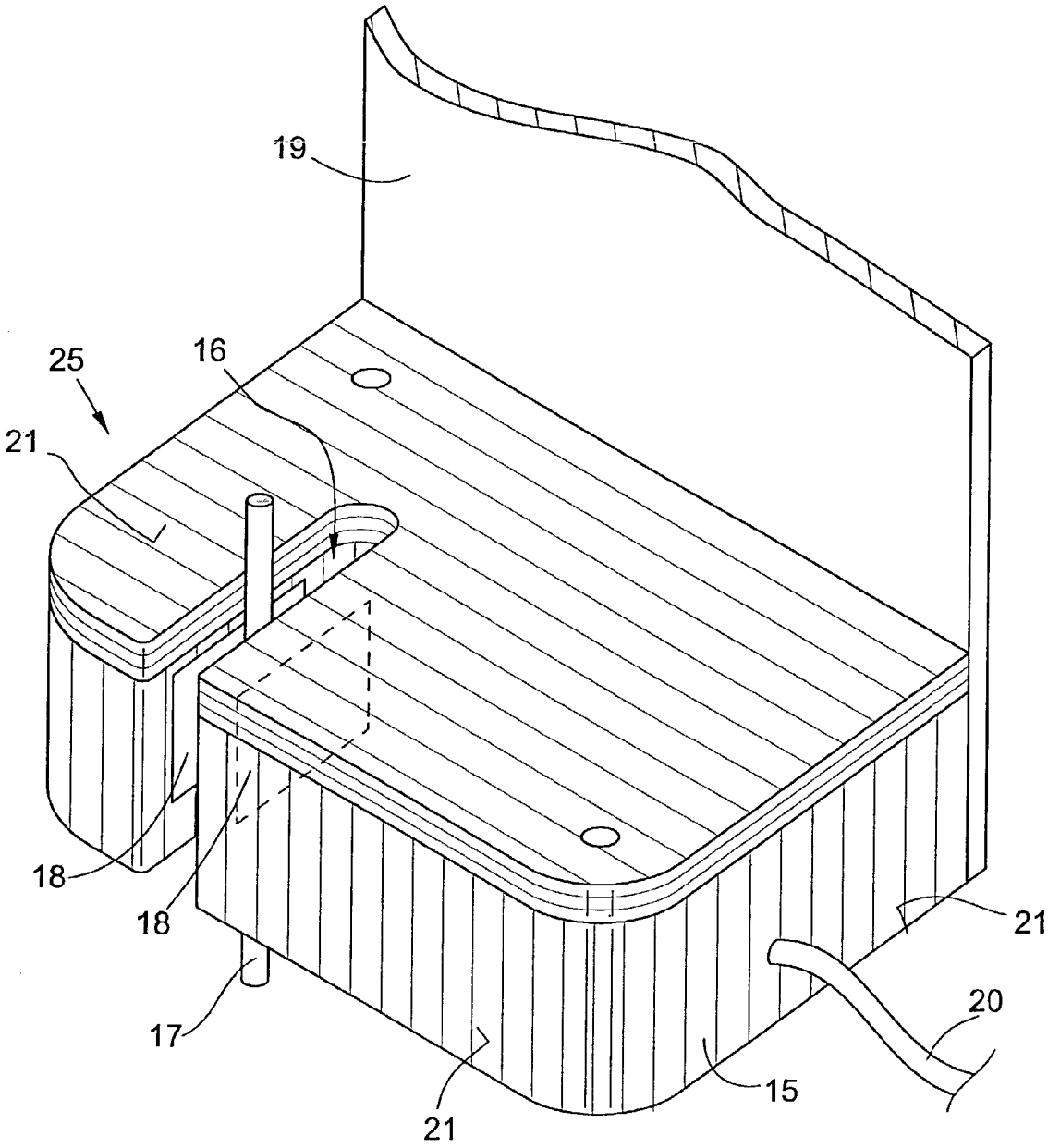
FIG. 2 is a basic perspective view of a one-piece housing in accordance with the present invention.

As an alternative embodiment, FIG. 2 shows a yarn sensor 25 with a housing, whose base body 15 is embodied in one piece. The base body 15 has a measuring gap 16 through which the yarn 17 travels. The surface of the base body 15 is metallic-coated to a large extent. Only in the measuring area 18 of the measuring gap 16 is the surface not coated. It is intended in this manner to prevent an undesired influencing of the measurement results, in particular in connection with capacitive measuring. The base body 15 of the housing is connected via the support plate 19 with the frame, not represented for reasons of simplification, of the textile machine. Data as well as signal conveyance between the yarn sensor 25 and the central control of the textile machine takes place via the line 20. The coated surface of the base body 15 lies flat against the support plate 19.

Figure 3:
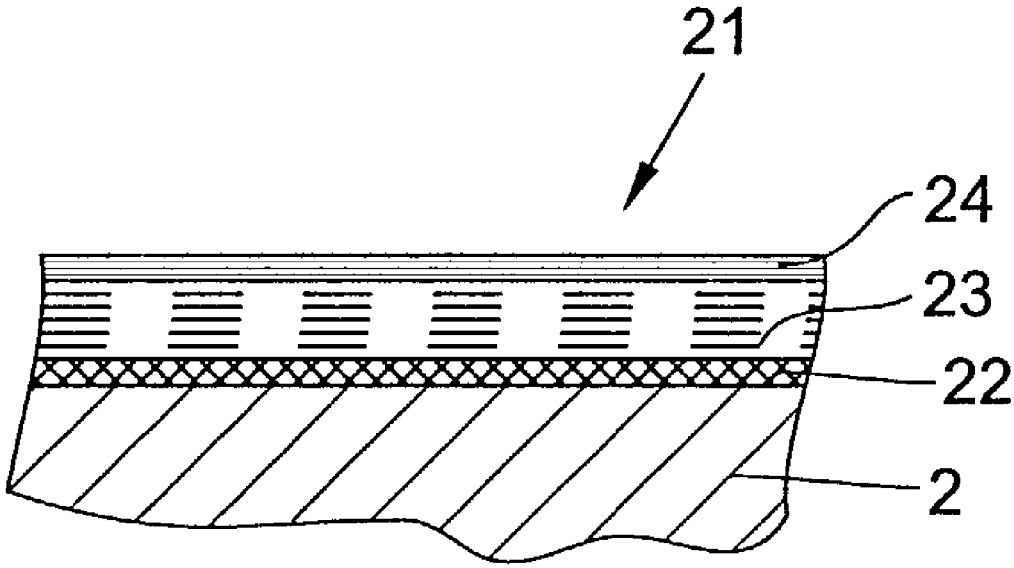
FIG. 3 is a partial sectional view of a coated surface for the housing of the yarn sensor of the present invention.

The coating 21 represented in FIG. 3 consists of three layers 22, 23, 24, which have been applied to the base body 2 of the housing. The base layer 22, applied by means of a chemical process, is a nickel layer of a thickness between 0.5 $\mu$m and 1 $\mu$m. A copper layer 23 has been electrolytically applied on top of the nickel layer by means of a galvanic process. A cover layer 24 of nickel has also been electrolytically applied. The thickness of the copper layer 23 is approximately 50 percent of the entire coating.

More detailed information regarding the coating process can be taken from German Patent Publication DE-OS 22 55 430, for example.

The coating of the base body 2 and the cover 3 of the yarn sensor in FIG. 1, or of the one-piece base body 15 of the yarn sensor in FIG. 2, provides an effective shielding against outside electrical or magnetic fields, and prevents the distortion of the measurement results by such fields.

Waste heat being released in the yarn sensor, for example from the light source, or from other electrical components, such as processors 12, is removed via the metallic coating 21 to the support plate 14, 19, or the machine frame, and to the surrounding atmosphere.

The cover layer 24 of nickel offers protection against wear which is substantially improved over the plastic surface. In comparison to a surface made of copper, nickel also offers improved wear protection. In place of a cover layer of nickel as the outer surface, a cover layer of chromium can alternatively be applied.

Further alternative embodiments of a yarn sensor in accordance with the invention are possible. The shape of the housing of the yarn sensor in particular can be varied. The housing to be coated can for example have a shape like that of the housing represented in European Patent Publication EP 0 945 533 A1, however, a coating in accordance with the invention cannot be found in European Patent Publication EP 0 945 533 A1.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A yarn sensor for monitoring at least one parameter of a traveling length of yarn, the yarn sensor comprising an enclosed housing containing electronic components including a yarn measuring device for detecting the at least one parameter of the traveling length of yarn, the housing being formed of a non-conductive plastic material having an outer surface completely surrounding the electronic components on all sides thereof and including a measuring gap extending interiorly and configured to define a confined path for contactlessly containing the length of yarn while traveling through the measuring gap, the entirety of the outer surface of the housing having a metallic covering shielding the electronic components against the effects of all electrical and magnetic fields external of the housing except for a defined surface disposed solely within the interior of the measuring gap which is free of the metallic covering for exposing the traveling length of yarn to the yarn measuring device.

2. The yarn sensor in accordance with claim 1, characterized in that the metallic covering of the yarn sensor is connected with a heat conductor for removing heat via the metallic covering.

3. The yarn sensor in accordance with claim 1, characterized in that the metallic covering is formed of at least two layers including a base layer chemically applied directly on the outer surface of the housing and at least one outer layer galvanically applied outwardly over the base layer.

4. The yarn sensor in accordance with claim 1, characterized in that the metallic covering comprises a copper base layer and an outer layer of nickel or chromium.

5. The yarn sensor in accordance with claim 1, characterized in that the metallic covering has a thickness between about 5 $\mu$m and about 20 $\mu$m.

* * * * *